US009598931B2

(12) United States Patent
Murphree et al.

(10) Patent No.: US 9,598,931 B2
(45) Date of Patent: Mar. 21, 2017

(54) MULTI-ACTING DOWNHOLE TOOL ARRANGEMENT

(71) Applicant: HALLIBURTON ENERGY SERVICES, INC., Houston, TX (US)

(72) Inventors: Zachary Ryan Murphree, Dallas, TX (US); Michael Linley Fripp, Carrollton, TX (US); Zachary William Walton, Carollton, TX (US)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 12 days.

(21) Appl. No.: 14/443,006

(22) PCT Filed: Jun. 24, 2014

(86) PCT No.: PCT/US2014/043906

§ 371 (c)(1),
(2) Date: May 14, 2015

(87) PCT Pub. No.: WO2015/199660

PCT Pub. Date: Dec. 30, 2015

(65) Prior Publication Data

US 2016/0273305 A1 Sep. 22, 2016

(51) Int. Cl.
*E21B 34/10* (2006.01)
*E21B 34/06* (2006.01)
(Continued)

(52) U.S. Cl.
CPC ..... *E21B 34/10* (2013.01); *E21B 34/063* (2013.01); *E21B 34/066* (2013.01); *E21B 34/14* (2013.01);
(Continued)

(58) Field of Classification Search
CPC .. E21B 34/10; E21B 2034/005; E21B 34/063; E21B 34/08; E21B 2034/007;
(Continued)

(56) References Cited

U.S. PATENT DOCUMENTS 5,819,853 A * 10/1998 Patel ..... E21B 34/063 166/319
7,478,678 B2 1/2009 Farrar et al.
(Continued)

FOREIGN PATENT DOCUMENTS

WO 2013015992 A2 1/2013

OTHER PUBLICATIONS

International Search Report and Written Opinion mailed Mar. 24, 2015; in PCT patent application No. PCT/US2014/043906.

*Primary Examiner* — Kipp Wallace
(74) *Attorney, Agent, or Firm* — Polsnielli PC

(57) ABSTRACT

A multi-acting downhole tool arrangement (100), (400), (500) includes a tubular (102) and an actuatable sliding member (104), (404), (504) radially disposed relative to the tubular (102) in a radial sealing relationship. The tubular (102) and the member (104), (404), (504) are arranged relative to one another in a non-slidable first configuration. The sliding member (104), (404), (504) and the tubular (102) cooperate to define a chamber 116 therebetween. At least a pair of seals (108), (110), (410), (446) delimits the chamber (116). A first one (110), (446) of the pair of seals is a degradable seal. Upon actuation of the sliding member (104), (404), (504), the sliding member (104), (404), (504) slides in a first direction relative to the tubular (102) to a second configuration where the degradable seal (110), (446) is exposed to a condition that degrades the degradable seal (110), (446). Degradation of the degradable seal (110), (446) opens a passage to the chamber (116) such that fluid enters the chamber (116) and urges the sliding member (104), (404), (504), in a second direction relative to the first direction, to a third configuration.

23 Claims, 7 Drawing Sheets

(51) Int. Cl.
*E21B 34/14* (2006.01)
*E21B 43/26* (2006.01)
*E21B 34/00* (2006.01)

(52) U.S. Cl.
CPC ..... *E21B 43/26* (2013.01); *E21B 2034/007* (2013.01)

(58) Field of Classification Search
CPC ..... E21B 34/101; E21B 34/103; E21B 43/12; E21B 2034/002; F16K 17/162
See application file for complete search history.

(56) References Cited

U.S. PATENT DOCUMENTS 7,562,712 B2 * 7/2009 Cho ..... E21B 23/04 166/319
7,703,510 B2 4/2010 Xu
2002/0074129 A1 * 6/2002 Moore ..... E21B 34/10 166/375
2003/0127227 A1 7/2003 Fehr et al.
2004/0154803 A1 * 8/2004 Anderson ..... E21B 34/102 166/332.8
2006/0196678 A1 * 9/2006 Connell ..... E21B 43/103 166/380
2008/0271883 A1 * 11/2008 Barton ..... E21B 34/063 166/332.8
2010/0200245 A1 * 8/2010 Ringgenberg ..... E21B 23/006 166/375
2011/0037004 A1 * 2/2011 Lake ..... E21B 34/066 251/129.01
2011/0155396 A1 6/2011 Pinard et al.
2012/0062356 A1 3/2012 Mann et al.
2013/0180721 A1 7/2013 Getzlaf et al.
2015/0315873 A1 * 11/2015 Mailand ..... E21B 34/125 166/307

* cited by examiner

MULTI-ACTING DOWNHOLE TOOL ARRANGEMENT

CROSS-REFERENCE TO RELATED APPLICATIONS

This application is a national stage entry of PCT/US2014/043906 filed Jun. 24, 2014, said application is expressly incorporated herein in its entirety.

FIELD

The present disclosure relates generally to downhole tool arrangements and, more particularly, to tool arrangements that can be actuated multiple times downhole.

BACKGROUND

In some downhole operations, for example, hydraulic fracturing ("fracking") operations, a tool is actuated downhole. A downhole tool arrangement sometimes includes a tubular surrounding a sliding member. The sliding member is initially stationary, but can be actuated downhole so that it can slide axially relative to the tubular. Pressure can then be applied to the sliding member to slide the member relative to the tubular. The relative movement between the sliding member and tubular can open a port, for example, to allow a fracking operation.

BRIEF DESCRIPTION OF THE DRAWINGS

Implementations of the present technology will now be described, by way of example only, with reference to the attached figures, wherein.

Figure 1:
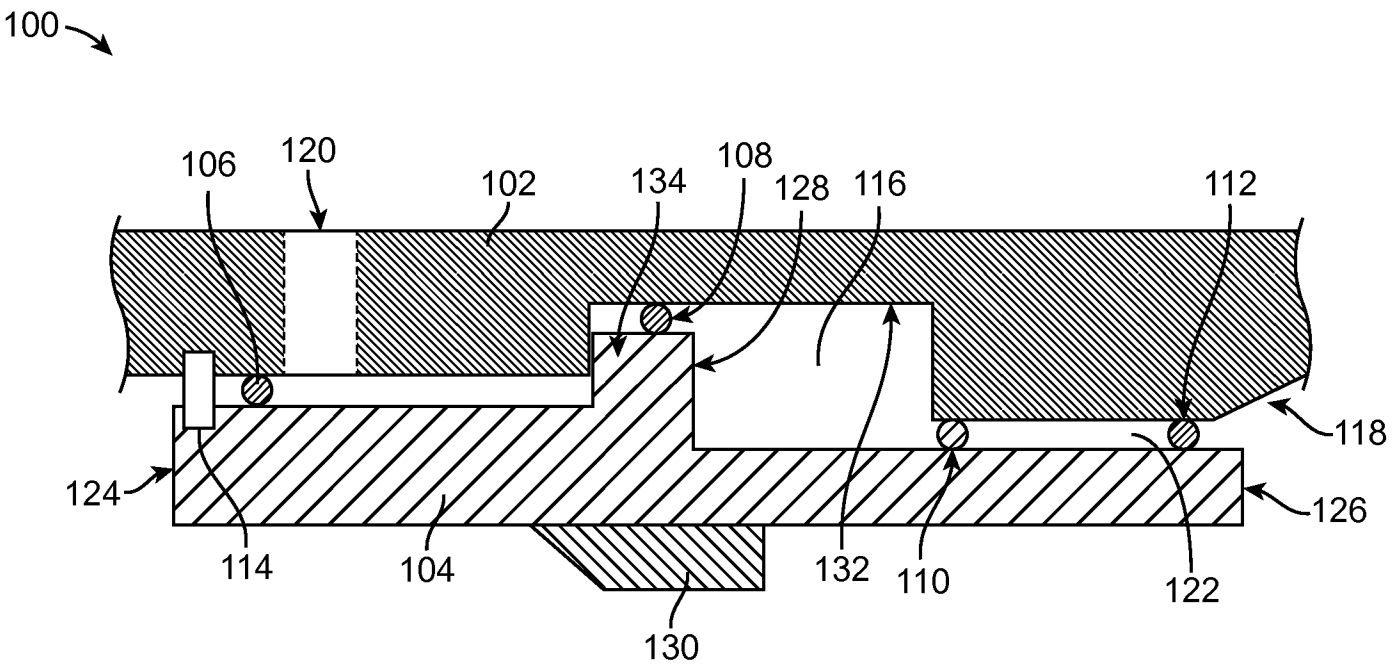
FIG. 1 is a schematic cross-sectional illustration of an exemplary multi-acting downhole tool arrangement in accordance with the disclosure.

It should be understood that the various embodiments are not limited to the arrangements and instrumentality shown in the drawings.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder.

The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

An exemplary downhole tool arrangement 100 according to the present disclosure is shown in the schematic cross-sectional view of FIG. 1 in a first configuration. The downhole tool arrangement 100 includes a tubular 102 and a pressure-responsive actuator that is depicted as an actuatable sliding member 104, for example, a sliding sleeve, a piston, a cylindrical member, or any other tool component that is actuatable. The actuatable sliding member 104 is disposed radially inward relative to the tubular 102. A plurality of seals 106, 108, 110, 112 between the sliding member 104 and the tubular 102 enable an airtight radial sealing relationship between the tubular 102 and the sliding member 104. The seals 106, 108, 110, 112 are made of a material or materials that permit relative sliding movement between the tubular 102 and the sliding member 104 without tearing of the seals 106, 108, 110, 112.

In FIG. 1 the sliding member 104 and the tubular 102 are arranged relative to one another in a non-slidable configuration. In some embodiments, the sliding member 104 and the tubular 102 may be coupled together, for example, by a shear pin 114. In such embodiments, breaking of the shear pin 114 initially actuates the sliding member 104. In some embodiments, the sliding member 104 and the tubular 102 are coupled to one another via an electronically-actuatable arrangement (not shown) such that an electronic trigger (not shown) can be operated to initially actuate the sliding member 104. In still other embodiments, the non-slidable configuration of the sliding member 104 relative to the tubular 102 may be a result of hydraulic balance, friction, or the like.

The sliding member 104 and the tubular 102 cooperate to define a chamber 116 disposed between the tubular 102 and the sliding member 104. A pair of the seals 108, 110 delimits the chamber 116 in an axial direction. The seal 110 is a degradable seal. That is, the seal 110 is made of a material chosen such that it can initially provide a sealing relationship between the tubular 102 and the sliding member 104 and such that, when exposed to a predetermined condition, the seal 110 is degradable to a degree that it no longer provides the sealing relationship between the tubular 102 and the sliding member 104. Among others, the predetermined condition can be of a hydraulic, electrical or thermal nature.

In some embodiments, the seal 110 may be made of a material that degrades under predetermined conditions such as when exposed to a fluid available downhole, for instance, fluid in the tool or wellbore fluid. For example, if the available fluid is water/brine, the seal 110 can be a hydrolysable material such as PGA or PLA. If the available fluid is a petroleum-based hydraulic fluid, the seal 110 can be an incompatible elastomer or polymer, such as EPDM, that will degrade in such fluid. The seal 110 can also be a material that forms a galvanic couple with the tool metal such as, for example, magnesium, zinc, aluminum, or the like. The galvanic couple can also be intrinsic to the seal material. For example, the seal 110 can be a nano-composite galvanically-coupled alloy. The seal 110 can also be a material that degrades due to a thermal trigger. For example, the seal material can be chosen to melt at a given temperature.

Referring again to FIG. 1, in the first configuration, the sliding member 104 may be initially positioned axially relative to the tubular 102 to close a fluid communication port 120, for example, a frac port. In some embodiments, the fluid communication port 120 extends radially through the tubular 102 from an interior of the tubular 102 to an exterior. It should be understood that the tubular 102 may have a plurality of ports spaced apart circumferentially about the tubular 102 and closed by the sliding member 104 in the first configuration. One or more of the seals 106, 108, 110, 112 seal the port 120 from fluid passing through the sliding member 104, for example, borehole fluid. In such a sealed configuration, the port 120 can only communicate with an air chamber 122 between the sliding member 104 and the tubular 102. As shown in FIG. 1, the air chamber 122 does not fluidly communicate with the chamber 116 in the first configuration.

As shown in FIG. 1, the sliding member 104 has a first piston area 124, a second piston area 126, and a third piston area 128. The first piston area 124 is greater than the second piston area 126, but the combined area of the second and third piston areas 126, 128 is greater than the first piston area 124. In the first configuration, the first and second piston areas 124, 126 can be exposed to fluid flow within the tubular 102, while the third piston area 128 is blocked from fluid flow with the tubular 102.

In some embodiments, the sliding member 104 includes a baffle 130 extending radially inward from the sliding member 104. The baffle 130 provides an actuation surface for a frac ball (not shown) used in some hydraulic fracturing or "fracking" procedures. When a ball is dropped into a well, the ball will proceed from the heel of the well toward the toe of the well (from left-to-right in FIG. 1) until the ball engages a baffle 130 having an inner diameter smaller than the diameter of the frac ball. Contact of the frac ball with the baffle 130 actuates the sliding member 104 by breaking the shear pin 114. Once the shear pin 114 is broken, the sliding member 104 is free to slide axially relative to the tubular 102. The length of relative axial movement between the sliding member 104 and the tubular 102 is limited by, for example, an annular channel 132 in the tubular 102 and annular extension 134 of the sliding member 104. That is, the sliding member 104 is slidable relative to the tubular 102 along an axial distance in which extension 134 can move axially in the channel 132.

Figure 2:
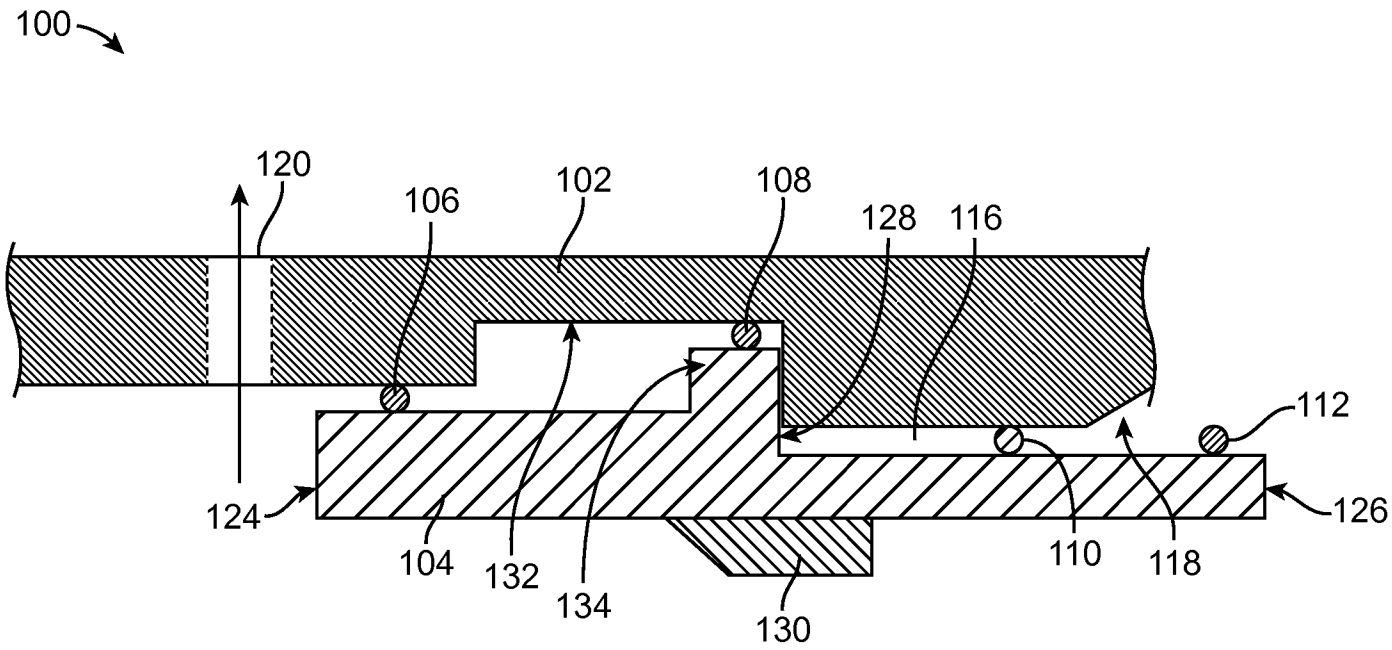
FIG. 2 is a schematic cross-sectional illustration of the exemplary tool arrangement of FIG. 1 in a second configuration.

Referring now to FIG. 2, the downhole tool arrangement 100 is illustrated in a second configuration, which occurs at a time after the sliding member 104 has been actuated and decoupled from the tubular 102. In moving from the first configuration to the second configuration, the sliding member 104 slides axially relative to the tubular 102. As mentioned above, the sliding member 104 can be decoupled from the tubular 102 by breaking the shear pin 114 or by electronically triggering an electrically-actuatable coupling arrangement (not shown). After the sliding member 104 and tubular 102 are decoupled, the force of borehole fluid against the first piston area 124 urges the sliding member 104 axially relative to the tubular 102 to the second configuration. The distance of relative axial movement between the sliding member 104 and the tubular 102 is limited by the annular channel 132 in the tubular 102 and the annular extension 134 of the sliding member 104. Since the first piston surface 124 is greater than the second piston surface 126, the relative axial movement from the first configuration to the second configuration can occur regardless of whether a frac ball forms a seal with the baffle or not. For example, the relative sliding movement can occur in a fracking operation where the frac ball degrades or is returned to the surface or in an operation other than fracking, such as for example a multi-zone gravel packing application, a retrievable packer, or the like.

As shown in FIG. 2, in the second configuration of the downhole tool arrangement 100, the port 120 is opened, for example, to receive frac fluid for a fracking operation. Also in the second configuration, due to a structural relief 118 of the tubular 102, the degradable seal 110 is no longer sealed from fluids by the adjacent seals 108, 112. The degradable seal 110 can then be exposed to fluid that can degrade the seal 110. It should be appreciated that the degradable seal 110 can be made of a material that degrades over a desired period of time when exposed to the type of borehole fluid selected. For example, in a fracking operation, the time for degrading the seal can approximate the expected time that it will take to perform hydraulic fracturing via the port 120.

After the seal 110 degrades to a degree that it can no longer maintain the fluid-tight seal between the sliding member 104 and tubular 102, the borehole fluid can enter the chamber 116 and act with force against the third piston area 128 of the sliding member 104. Since the second and third piston areas 126, 128 combine to have a larger surface area than the first piston area 124, the downhole fluid urges the sliding member 104 in an axial direction relative to the tubular 102 to a third configuration (FIG. 3).

Figure 3:
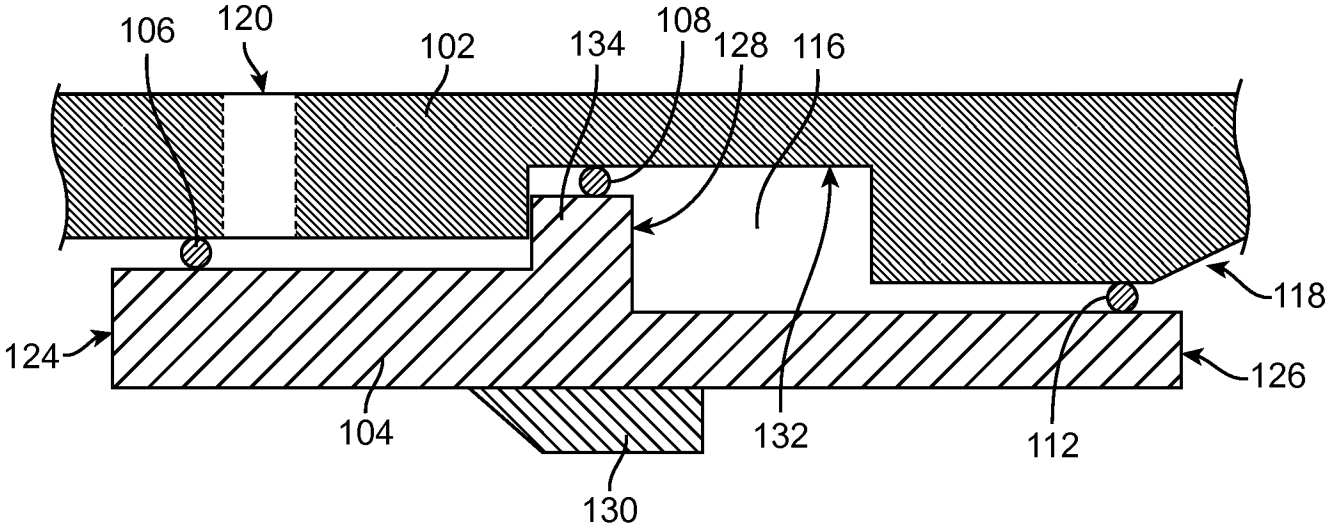
FIG. 3 is a schematic cross-sectional illustration of the exemplary tool arrangement of FIG. 1 in a third configuration.

Referring now to FIG. 3, the third configuration can have a substantially similar relative alignment between the tubular 102 and sliding member 104 as does the first configuration. For example, in the third configuration, the port 120 is once again closed by the sliding member 104 such that borehole fluid cannot exit the tubular 102 via the port 120. Wellbore fluid in the chamber 116 and the force of wellbore fluid on the second piston area 126 oppose the force of wellbore fluid on the first piston surface 124 to maintain the downhole tool arrangement in the third configuration. It should be appreciated that the sliding member 104 can subsequently be removed or re-actuated, either mechanically or electronically, in order to reopen the port 120, for example, for extraction of petroleum or natural gas via a fracked region.

It should be appreciated that, in some embodiments, the seal 106 can be constructed of a degradable material that can degrade over a much longer period than seal 110 if exposed to the same fluid. Or the seal 106 can be constructed of a material that degrades in the presence of a fluid different from that of seal 110. In any event, if the seal 106 degrades to a degree that it can no longer maintain the fluid-tight seal between the sliding member 104 and tubular 102, the borehole fluid can urge the sliding member 104 in an axial direction relative to the tubular 102 to a fourth configuration (similar to that shown in FIG. 2), as described in more detail below with reference to FIG. 5.

Figure 4:
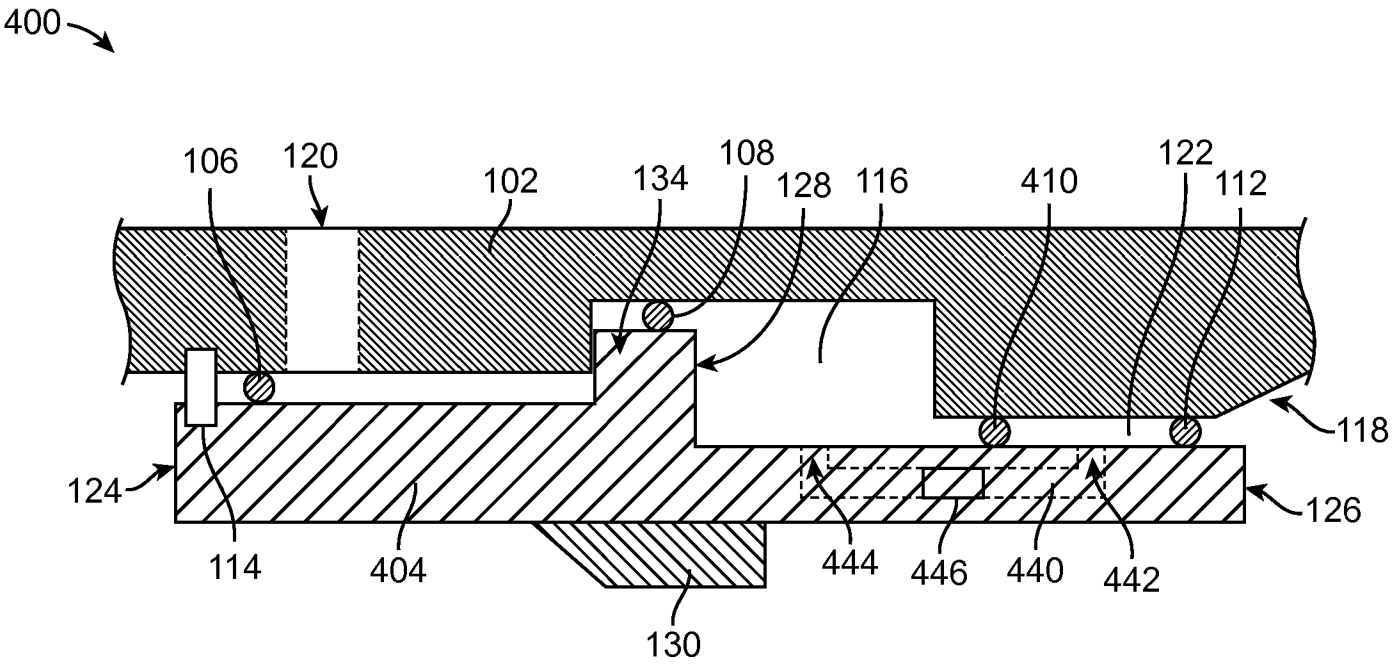
FIG. 4 is a schematic cross-sectional illustration of an exemplary multi-acting downhole tool arrangement in accordance with the disclosure.

FIG. 4 schematically illustrates a cross-section of another exemplary downhole tool arrangement 400. The downhole tool arrangement 400 is similar to downhole arrangement 100 and includes a sliding member 404 similar to the previously-described sliding member 104. The sliding member 404 includes a passage 440 extending through a portion of the sliding member 404. The passage 440 has a first port 442 opening between seals 410 and 112 and a second port 444 opening into the fluid chamber 116. The seal 410 is not degradable, and therefore cooperates with the seal 108 to delimit the chamber 116.

The sliding member 404 includes a degradable plug 446 that provides a fluid-tight seal of the passage between the first and second ports 442, 444. That is, the plug 446 is made of a material chosen such that it can initially provide a sealing relationship, but that is subsequently degradable to an extent that it no longer provides the sealing relationship. In some embodiments, the plug 446 may be made of a material that degrades in the presence of a fluid available downhole, either fluid in the tool or wellbore fluid. For example, if the available fluid is water/brine, the plug 446 can be a hydrolysable material such as PGA or PLA. If the available fluid is a petroleum-based hydraulic fluid, the plug 446 can be an incompatible elastomer or polymer, such as EPDM, that will degrade in such fluid. The plug 446 can also be a material that forms a galvanic couple with the tool metal such as, for example, magnesium, zinc, aluminum, or the like. The galvanic couple can also be intrinsic to the plug material. For example, the plug 446 can be a nano-composite galvanically-coupled alloy. The plug 446 can also be a material that degrades due to a thermal trigger. For example, the plug material can be chosen to melt at a given temperature.

The actuation of the sliding member 404 in the downhole tool arrangement 400 is similar to that discussed above relative to downhole tool arrangement 100. When the sliding member 404 moves axially relative to the tubular 102 from the first configuration (FIG. 4) to a second configuration (similar to that shown in FIG. 2), seal 112 no longer provides a sealing arrangement between the sliding member 404 and the tubular 102, and the second port 444 is opened to borehole fluid. Thus, the degradable plug 446 is exposed to the borehole fluid and begins to degrade at a rate dependent upon the material of the plug 446 and the makeup of the borehole fluid. Once the plug 446 degrades to the extent that it no longer provides a fluid-tight seal of the passage 440, borehole fluid can enter the chamber 116 via the first port 442. When the borehole fluid enters the chamber 116, the borehole fluid can act with force against the third piston area 128 of the sliding member 404. Since the second and third piston areas 126, 128 combine to have a larger surface area than the first piston area 124, the borehole fluid urges the sliding member 404 in an axial direction relative to the tubular 102 to a third configuration (similar to that shown in FIG. 3). In the third configuration, the port 120 can once again be closed by the sliding member 404.

Figure 5:
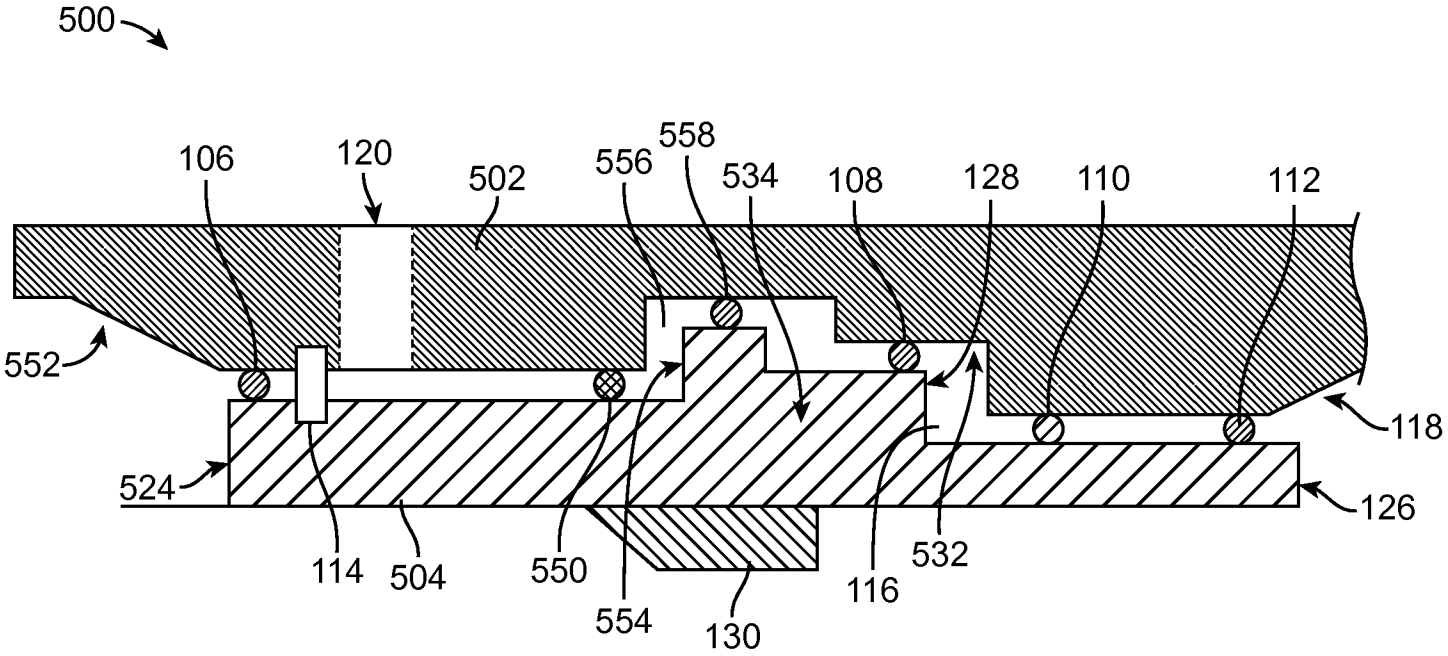
FIG. 5 is a schematic cross-sectional illustration of an exemplary multi-acting downhole tool arrangement in accordance with the disclosure.

Referring now to FIG. 5, a cross-section of still another exemplary downhole tool arrangement 500 is schematically illustrated. The downhole tool arrangement 500 is similar to downhole arrangement 100 and includes a tubular 502 similar to the previously-described tubular 102 and a sliding member 504 similar to the previously-described sliding member 104.

The downhole tool arrangement 500 includes a plurality of seals 106, 108, 110, 112, 550 between the sliding member 504 and the tubular 502 enabling an airtight radial sealing relationship between the tubular 502 and the sliding member 504. The seals 106, 108, 110, 112, 550 are made of a material that permits relative sliding movement between the tubular 502 and the sliding member 504 without tearing the seals 106, 108, 110, 112, 550. The seals 110, 550 are degradable seals. That is, the seals 110, 550 are made of a material chosen such that it can initially provide a sealing relationship between the tubular 502 and the sliding member 504 and such that it is degradable to a degree that it no longer provides the sealing relationship between the tubular 502 and the sliding member 504. In some embodiments, the seals 110, 550 may be made of a material that degrades in the presence of a fluid available downhole, either fluid in the tool or wellbore fluid. For example, if the available fluid is water/brine, the seals 110, 550 can be a hydrolysable material such as PGA or PLA. If the available fluid is a petroleum-based hydraulic fluid, the seals 110, 550 can be an incompatible elastomer or polymer, such as EPDM, that will degrade in such fluid. The seals 110, 550 can also be a material that forms a galvanic couple with the tool metal such as, for example, magnesium, zinc, aluminum, or the like. The galvanic couple can also be intrinsic to the seal material. For example, the seals 110, 550 can be a nano-composite galvanically-coupled alloy. The seals 110, 550 can also be a material that degrades due to a thermal trigger. For example, the seal material can be chosen to melt at a given temperature.

FIG. 5 illustrates a first configuration of the downhole tool arrangement 500 wherein the sliding member 504 and the tubular 502 are arranged relative to one another in a non-slidable configuration. The actuation of the sliding member 504 in the downhole tool arrangement 500 is similar to that discussed above relative to downhole tool arrangement 100. When the sliding member 504 moves axially relative to the tubular 502 from the first configuration (FIG. 5) to a second configuration (similar to that shown in FIG. 2).

As shown in FIG. 5, the sliding member 504 has a first piston area 524, a second piston area 126, a third piston area 128, and a fourth piston area 554. The first piston area 124 is greater than the second piston area 126, but the combined area of the second and third piston areas 126, 128 is greater than the first piston area 124. The combined area of the first and fourth piston areas 524, 554 is greater than the combined area of the second and third piston areas 126, 128. In the first configuration, the first and second piston areas 524, 126 are exposed to fluid flow within the tubular 502, while the third piston area 128 is blocked from fluid flow within the tubular 502 by seals 108, 110. The fourth piston area 554 is blocked from fluid flow in the first configuration by seals 550, 558, and an air chamber is formed between seals 108, 558.

When the downhole tool arrangement 500 moves from the first configuration to a second configuration (similar to FIG. 2 above), which occurs at a time after the sliding member 504 has been actuated and decoupled from the tubular 502, the sliding member 504 slides axially relative to the tubular 502. After the sliding member 504 and tubular 502 are decoupled, the force of borehole fluid against the first piston area 524 urges the sliding member 504 axially relative to the tubular 502 to the second configuration. The distance of relative axial movement between the sliding member 504 and the tubular 502 is limited by the annular channel 532 in the tubular 502 and the annular extension 534 of the sliding member 504. The annular extension 534 is a stepped extension.

Similar to FIG. 2, in the second configuration of the downhole tool arrangement 500, the port 120 is opened, for example, to receive frac fluid for a fracking operation. Also in the second configuration, due to a structural relief 118 of the tubular 102, the degradable seal 110 is no longer sealed from fluids by the adjacent seals 108, 112. The degradable seal 110 can then be exposed to fluid that degrades the seal 110. It should be appreciated that the degradable seal 110 can be made of a material that degrades over a desired period of time when exposed to the type of borehole fluid selected. For example, in a fracking operation, the time for degrading the seal can approximate the expected time that it will take to perform hydraulic fracturing via the port 120. It should also be understood that the sliding member 504 can include a passage with a plug, similar to the embodiment of FIG. 4, and the degradable seal 110 can be replaced with a non-degradable seal.

After the seal 110 degrades to a degree that it can no longer maintain the fluid-tight seal between the sliding member 504 and tubular 502, the borehole fluid can enter the chamber 116 and act with force against the third piston area 128 of the sliding member 504. Since the second and third piston areas 126, 128 combine to have a larger surface area than the first piston area 524, the downhole fluid urges the sliding member 504 in an axial direction relative to the tubular 502 to a third configuration (similar to FIG. 3).

In the third configuration, the port 120 is once again closed by the sliding member 504 such that borehole fluid cannot exit the tubular 502 via the port 120. Wellbore fluid in the chamber 116 and the force of wellbore fluid on the second piston area 126 opposes the force of wellbore fluid on the first piston surface 524 to maintain the downhole tool arrangement in the third configuration. In the third configuration, due to the axial length of the channel 532, which is a stepped channel, the position of the sliding member 504 relative to the tubular 502 in the first configuration, and a structural relief 552 of the tubular 502, the degradable seal 550 is no longer sealed from fluids by the adjacent seals 106, 558. The degradable seal 550 can then be exposed to fluid that can degrade the seal 550. It should be appreciated that the degradable seal 550 can be made of a material that degrades over a desired period of time when exposed to the type of borehole fluid selected.

After the seal 550 degrades to a degree that it can no longer maintain the fluid-tight seal between the sliding member 504 and tubular 502, the borehole fluid can enter a chamber 556 and act with force against the fourth piston area 554 of the sliding member 504. Since the first and fourth piston areas 524, 554 combine to have a larger surface area than the second and third piston areas 126, 128, the downhole fluid can urge the sliding member 504 in an axial direction relative to the tubular 502 to a fourth configuration (similar to that shown in FIG. 2). It should be understood that the chamber 116 can be provided with a pressure relief passage (not shown) such that fluid contained in the chamber 116 can be relieved from the chamber when a predetermined pressure is applied to the fourth piston surface 554 to permit relative axial movement between the member 504 and the tubular 502 to the fourth configuration. In the fourth configuration of the downhole tool arrangement 500, the port 120 is re-opened, for example, to again receive frac fluid for a fracking operation or to allow extraction of petroleum or natural gas from a fracked region.

Alternatively, the multi-acting downhole tool 100 of FIGS. 1-3 can be described as including a tool housing 102 with a pressure responsive actuator 104 disposed at least partially within the tool housing 103 in a first configuration (FIG. 1), and in which the tool housing 102 and actuator 104 cooperatively define a chamber 116 therebetween. As shown, the chamber 116 is delimited by at least a pair of seals 108, 110, a first one of which is a degradable seal 110. Upon actuation, the actuator 104 transitions to a second configuration (FIG. 2) in which the degradable seal 110 is exposed to a condition that degrades the degradable seal 110, and degradation of the degradable seal 110 opens a passage to the chamber 110 permitting fluid to enter the chamber 116 and which transitions the actuator 104 to a third configuration (FIG. 3) in which the actuator 104 is poised again for actuation to the second configuration (FIG. 2) upon receiving pressure actuation.

Figure 6:
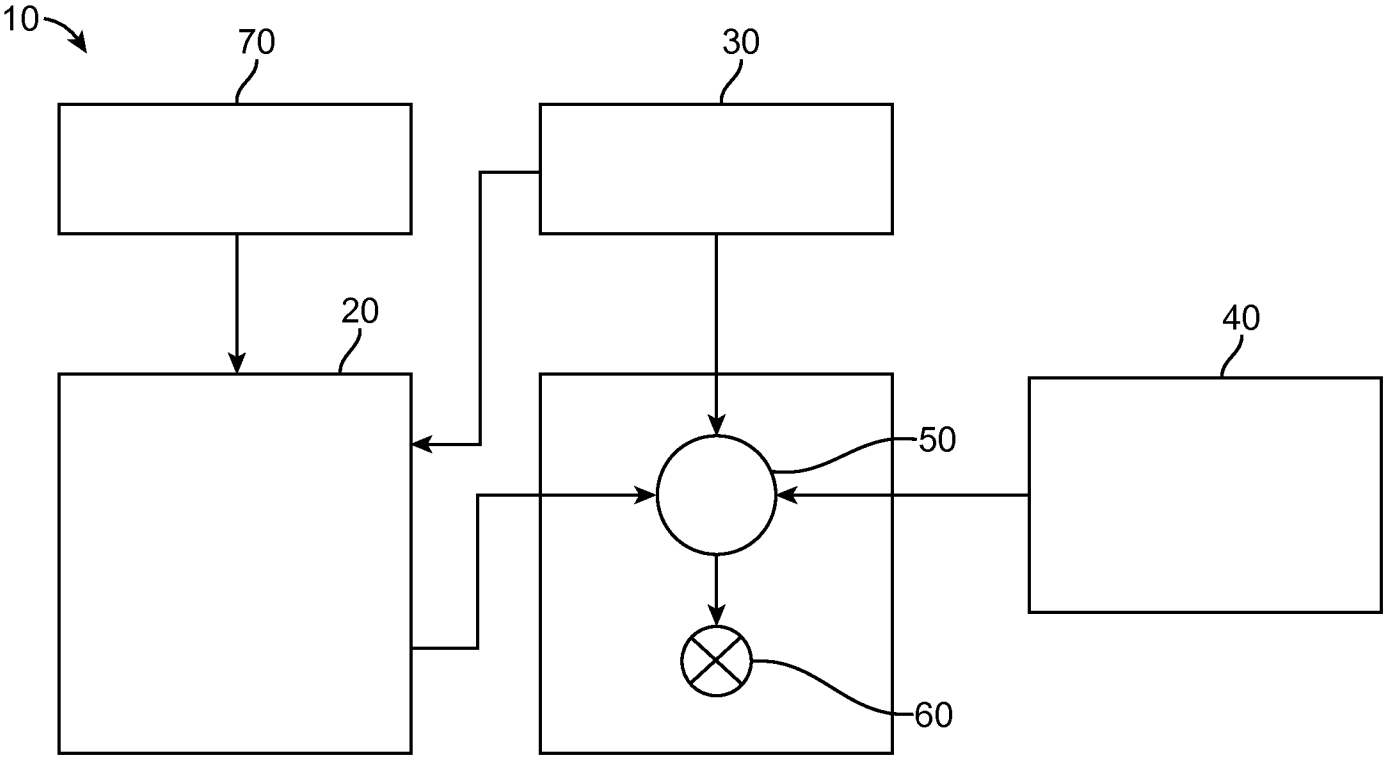
FIG. 6 is a diagram illustrating an example of a fracturing system that may be used in association with certain embodiments of the present disclosure.
Figure 7:
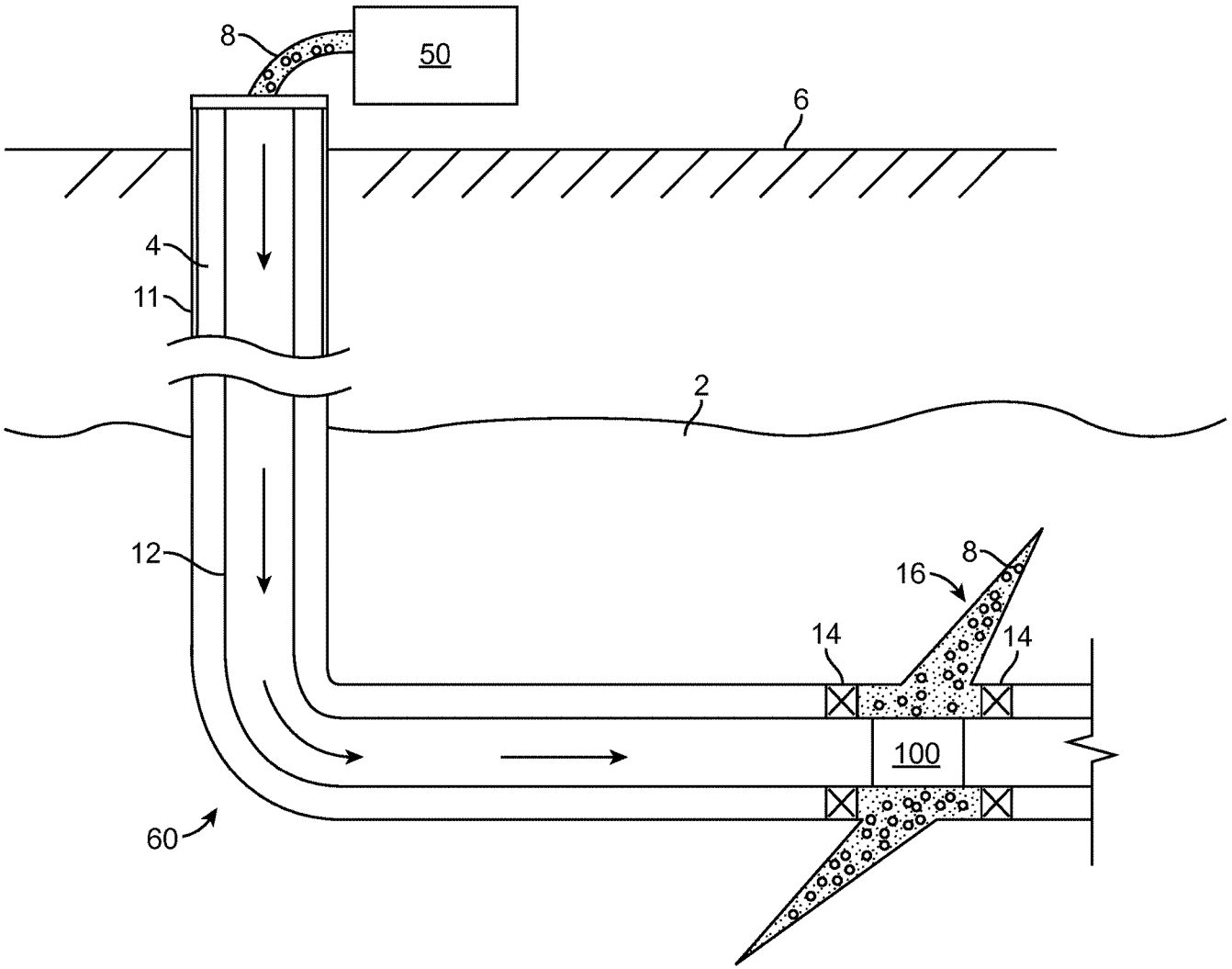
FIG. 7 is a diagram illustrating an example of a subterranean formation in which a fracturing operation may be performed in association with certain embodiments of the present disclosure.

The exemplary tools 100, 400, 500, systems and methods that are disclosed herein may directly or indirectly affect one or more components or pieces of equipment associated with the preparation, delivery, recapture, recycling, reuse, and/or disposal of drilling fluids, including drilling fluids used in hydraulic fracturing procedures. An exemplary fracturing system is illustrated in FIGS. 6 and 7. As described hereinabove, the disclosed multi-acting downhole tool 100 can be utilized in such fracturing procedures and can directly and/or indirectly affect one or more components or pieces of equipment associated with the depicted fracturing system 10. In this example, the system 10 includes a fracturing fluid producing apparatus 20, a fluid source 30, a proppant source 40, and a pump and blender system 50 and resides at the surface at a well site where a well 60 is located. In certain instances, the fracturing fluid producing apparatus 20 combines a gel pre-cursor with fluid (e.g., liquid or substantially liquid) from fluid source 30, to produce a hydrated fracturing fluid that is used in fracturing the formation, for example, by being pumped through the multi-acting downhole tool 100 (see FIG. 7) when in the open configuration. The hydrated fracturing fluid can be a fluid for ready use in a fracture stimulation treatment of the well 60 or a concentrate to which additional fluid is added prior to use in a fracture stimulation of the well 60. In other instances, the fracturing fluid producing apparatus 20 can be omitted and the fracturing fluid sourced directly from the fluid source 30. In certain instances, the fracturing fluid may comprise water, a hydrocarbon fluid, a polymer gel, foam, air, wet gases and/or other fluids.

The proppant source 40 can include a proppant for combination with the fracturing fluid. The system may also include additive source 70 that provides one or more additives (e.g., gelling agents, weighting agents, and/or other optional additives) to alter the properties of the fracturing fluid. For example, the other additives 70 can be included to reduce pumping friction, to reduce or eliminate the fluid's reaction to the geological formation in which the well is formed, to operate as surfactants, and/or to serve other functions.

The pump and blender system 50 receives the fracturing fluid and combines it with other components, including proppant from the proppant source 40 and/or additional fluid from the additives 70. The resulting mixture may be pumped down the well 60 and out through the multi-acting downhole tool 100 under a pressure sufficient to create or enhance one or more fractures in a subterranean zone, for example, to stimulate production of fluids from the zone. Notably, in certain instances, the fracturing fluid producing apparatus 20, fluid source 30, and/or proppant source 40 may be equipped with one or more metering devices (not shown) to control the flow of fluids, proppants, and/or other compositions to the pumping and blender system 50. Such metering devices may permit the pumping and blender system 50 to source from one, some or all of the different sources at a given time, and may facilitate the preparation of fracturing fluids using continuous mixing or "on-the-fly" methods. Thus, for example, the pumping and blender system 50 can distribute fracturing fluid and/or proppant through the multi-acting downhole tool 100 to the target subterranean zone.

FIG. 7 illustrates a well 60 performing a fracturing operation in a portion of a subterranean formation of interest 2 surrounding a well bore 4. The well bore 4 extends from the surface 6, and the fracturing fluid 8 is applied to a portion of the subterranean formation 2 surrounding the horizontal portion of the well bore through, for example, the multi-acting downhole tool 100. Although shown as vertical deviating to horizontal, the well bore 4 may include horizontal, vertical, slant, curved, and other types of well bore geometries and orientations, and the fracturing treatment may be applied to a subterranean zone surrounding any portion of the well bore. The well bore 4 can include a casing 11 that is cemented or otherwise secured to the well bore wall. The well bore 4 can be uncased or include uncased sections. Perforations can be formed in the casing 11 to allow fracturing fluids and/or other materials to flow into the subterranean formation 802, or instance, through multi-acting downhole tool 100, 400, 500. In cased wells, perforations can be formed using shape charges, a perforating gun, hydro-jetting and/or other tools.

The well is shown with a work string 12 depending from the surface 6 into the well bore 4. The pump and blender system 50 is coupled to the work string 12 to pump the fracturing fluid 8 into the well bore 4. The working string 12 may include coiled tubing, jointed pipe, and/or other structures that allow fluid to flow into the well bore 4. The working string 12 can include flow control devices such as the multi-acting downhole tool 100, 400, 500 that is disclosed herein and which controls the flow of fluid from the interior of the working string 12 into the subterranean zone 2. For example, the working string 12 can incorporate the multi-acting downhole tool 100, 400, 500 along the string's length with its openable/closeable ports adjacent the well bore wall to distribute fracturing fluid 8 directly into the subterranean formation 2. Alternatively, the working string 12 may include ports that are spaced apart from the well bore wall to communicate the fracturing fluid 8 into an annulus in the well bore between the working string 12 and the well bore wall.

The working string 12 and/or the well bore 4 may include one or more sets of packers 14 that seal the annulus between the working string 12 and well bore 4 to define an interval of the well bore 4 into which the fracturing fluid 8 will be pumped, for example, through the openable/closeable multi-acting downhole tool 100, 400, 500. FIG. 8 shows two packers 14, one defining an uphole boundary of the interval and one defining the downhole end of the interval. When the fracturing fluid 8 is introduced through the tool 100, 400, 500 into well bore 4 (e.g., in FIG. 8, the area of the well bore 4 between packers 14) at a sufficient hydraulic pressure, one or more fractures 16 may be created in the subterranean zone 2. The proppant particulates in the fracturing fluid 8 may enter the fractures 16 where they may remain after the fracturing fluid flows out of the well bore. These proppant particulates may "prop" fractures 16 such that fluids may flow more freely through the fractures 16.

While not specifically illustrated herein, the disclosed multi-acting downhole tools 100, 400, 500, systems and methods can also affect transport and delivery equipment used to convey the compositions that will be pumped through the tools 100, 400, 500 to the well site. Such equipment can include transport vessels, conduits, pipelines, trucks, tubulars, and/or pipes used to fluidically move the well fluids (fracturing fluids) from one location to another, any pumps, compressors, or motors used to drive the fluids into motion, any valves or related joints used to regulate the pressure or flow rate of the compositions, and any sensors (i.e., pressure and temperature), gauges, and/or combinations thereof.

Numerous examples are provided herein to enhance understanding of the present disclosure. A specific set of examples are provided as follows. In a first example there is disclosed herein a multi-acting downhole tool arrangement (100), (400), (500), including a tubular (102); an actuatable sliding member (104), (404), (504) radially disposed relative to the tubular (102) in a radial sealing relationship, the tubular and the sliding member being arranged relative to one another in a non-slidable first configuration, the sliding member (104), (404), (504) and the tubular (102) cooperating to define a chamber (116) therebetween; and at least a pair of seals (108), (110), (410), (446) delimiting the chamber, a first one (110), (446) of the pair of seals being a degradable seal; wherein, upon actuation of the sliding member (104), (404), (504), the sliding member (104), (404), (504) slides in a first axial direction relative to the tubular (102) to a second configuration where the degradable seal (110), (446) is exposed to a condition that degrades the degradable seal, and degradation of the degradable seal (110), (446) opens a passage to the chamber (116) such that fluid enters the chamber (116) and urges the sliding member (104), (404), (504), in a second axial direction relative to the tubular (102), to a third configuration.

In a second example, there is disclosed herein the arrangement according to the first example, wherein the tubular (102) includes a fluid communication port (120), the fluid communication port (120) being aligned relative to the sliding member (104), (404), (504) such that the port (120) is closed in the first configuration.

In a third example, there is disclosed herein the arrangement according to the first or second examples, wherein the fluid communication port (120) is opened in the second configuration.

In a fourth example, there is disclosed herein the arrangement according to any of the preceding examples first to the third, wherein the fluid communication port (120) is closed in the third configuration.

In a fifth example, there is disclosed herein the arrangement according to any of the preceding examples first to the fourth, wherein the third configuration is substantially the same as the first configuration.

In a sixth example, there is disclosed herein the arrangement according to any of the preceding examples first to the fifth, further including a second degradable seal (550), the second degradable seal (550) being exposed to a condition in the third configuration that degrades the second degradable seal (550), and degradation of the second degradable seal (550 opens a second passage to a second chamber (556) such that fluid enters the second chamber (556) and urges the sliding member (504), in the first axial direction relative to the tubular (102), to a fourth configuration.

In a seventh example, there is disclosed herein the arrangement according to any of the preceding examples first to the sixth, wherein the fourth configuration is substantially the same as the second configuration.

In an eighth example, there is disclosed herein the arrangement according to any of the preceding examples first to the seventh, wherein the sliding member (404), (504) includes a passage (440) that opens into the chamber (116), the degradable seal (446) being disposed in the passage (440).

In a ninth example, there is disclosed herein the arrangement according to any of the preceding examples first to the eighth, wherein the degradable seal (446) is a plug.

In a tenth example, there is disclosed herein the arrangement according to any of the preceding examples first to the ninth, wherein the condition is a hydraulic condition, an electrical condition, or a thermal condition.

In an eleventh example, there is disclosed herein a method for actuating a downhole tool arrangement (100), (400), (500), including delivering a tool arrangement (100), (400), (500) downhole, the tool arrangement (100), (400), (500) including a sliding member (104), (404), (504) and a tubular (102) arranged relative to one another in a non-slidable first configuration during delivery; and moving the sliding member (104), (404), (504) in a first axial direction relative to the tubular (102) downhole from the first configuration to a second configuration where a degradable seal (110), (446) is exposed to a condition that degrades the degradable seal (110), (446), and degradation of the degradable seal (110), (446) opens a passage to a chamber (116) such that fluid enters the chamber (116) and urges the sliding member (104), (404), (504), in a second axial direction relative to the tubular (102), to a third configuration.

In an twelfth example, there is disclosed herein the method according to the eleventh example, wherein the tubular (102) includes a fluid communication port (120), the fluid communication port (120) being aligned relative to the sliding member (104), (404), (504) such that the port (120) is closed in the first configuration.

In a thirteenth example, there is disclosed herein a method according to the eleventh or twelfth example, wherein relative movement to the second configuration opens the fluid communication port (120).

In a fourteenth example, there is disclosed herein the method according to any of the preceding examples eleventh to the thirteenth, wherein relative movement to the third configuration closes the fluid communication port (120).

In a fifteenth example, there is disclosed herein the method according to any of the preceding examples eleventh to the fourteenth, wherein the third configuration is substantially the same as the first configuration.

In a sixteenth example, there is disclosed herein the method according to any of the preceding examples eleventh to the fifteenth, wherein a second degradable seal (550) is exposed to a condition in the third configuration that degrades the second degradable seal (550), and degradation of the second degradable seal (550) opens a second passage to a second chamber (556) such that fluid enters the second chamber (556) and urges the sliding member (104), (404), (504), in the first axial direction relative to the tubular (102), to a fourth configuration.

In a seventeenth example, there is disclosed herein the method according to any of the preceding examples eleventh to the sixteenth, wherein the fourth configuration is substantially the same as the second configuration.

In an eighteenth example, there is disclosed herein the method according to any of the preceding examples eleventh to the seventeenth, wherein the sliding member (404), (504) includes a passage (440) that opens into the chamber (116), the degradable seal (446) being disposed in the passage (440).

In a nineteenth example, there is disclosed herein the method according to any of the preceding examples eleventh to the eighteenth, wherein the degradable seal (446) is a plug and wherein the condition is a hydraulic condition, an electrical condition, or a thermal condition.

In a twentieth example, there is disclosed herein a multi-acting downhole tool (100), including a tool housing (102); a pressure responsive actuator (104) disposed at least partially within the tool housing (102) and in a first configuration, the tool housing (102) and actuator (104) cooperatively define a chamber (116) therebetween; and at least a pair of seals (108), (110) delimiting the chamber (116), a first one of the pair of seals being a degradable seal (110), and wherein upon actuation, the actuator (104) transitions to a second configuration in which the degradable seal (110) is exposed to a condition that degrades the degradable seal, and degradation of the degradable seal (110) opens a passage to the chamber (116) such that fluid enters the chamber (116) and transitions the actuator (104) to a third configuration in which the actuator (104) is poised for actuation to the second configuration upon pressure actuation.

The embodiments shown and described above are only examples. Many details are often found in the art such as the other features of a downhole tool arrangement. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A multi-acting downhole tool arrangement comprising:

a tubular;

an actuatable sliding member radially disposed relative to the tubular in a radial sealing relationship, the tubular and the sliding member being arranged relative to one another in a non-slidable first configuration, the sliding member and the tubular cooperating to define a chamber therebetween; and at least a pair of seals delimiting the chamber, a first one of the pair of seals being a degradable seal;

wherein, upon actuation of the sliding member the sliding member slides in a first axial direction relative to the tubular to a second configuration and as a result of the sliding of the sliding member to the second configuration the degradable seal is exposed to a condition that degrades the degradable seal, and degradation of the degradable seal opens a passage to the chamber such that fluid enters the chamber and urges the sliding member in a second axial direction relative to the tubular to a third configuration.

2. The arrangement of claim 1, wherein the tubular includes a fluid communication port, the fluid communication port being aligned relative to the sliding member such that the port is closed in the first configuration.

3. The arrangement of claim 2, wherein the fluid communication port is opened in the second configuration.

4. The arrangement of claim 3, wherein the fluid communication port is closed in the third configuration.

5. The arrangement of claim 1, wherein the third configuration is substantially the same as the first configuration.

6. The arrangement of claim 1, further comprising a second degradable seal, the second degradable seal being exposed to a condition in the third configuration that degrades the second degradable seal, and degradation of the second degradable seal opens a second passage to a second chamber such that fluid enters the second chamber and urges the sliding member in the first axial direction relative to the tubular to a fourth configuration.

7. The arrangement of claim 6, wherein the fourth configuration is substantially the same as the second configuration.

8. The arrangement of claim 1, wherein the sliding member includes a passage that opens into the chamber, the degradable seal being disposed in the passage.

9. The arrangement of claim 8, wherein the degradable seal is a plug.

10. The arrangement of claim 1, wherein the condition is a hydraulic condition, an electrical condition, or a thermal condition.

11. The arrangement of claim 1, wherein the degradable seal is sealed by a second seal prior to actuation of the sliding member.

12. A method for actuating a downhole tool arrangement comprising:

delivering a tool arrangement downhole, the tool arrangement including a sliding member and a tubular arranged relative to one another in a non-slidable first configuration during delivery; and moving the sliding member in a first axial direction relative to the tubular downhole from the first configuration to a second configuration where as a result of the moving of the sliding member to the second configuration a degradable seal is exposed to a condition that degrades the degradable seal, and degradation of the degradable seal opens a passage to a chamber such that fluid enters the chamber and urges the sliding member in a second axial direction relative to the tubular to a third configuration.

13. The method of claim 12, wherein the tubular includes a fluid communication port, the fluid communication port being aligned relative to the sliding member such that the port is closed in the first configuration.

14. The method of claim 13, wherein relative movement to the second configuration opens the fluid communication port.

15. The method of claim 14, wherein relative movement to the third configuration closes the fluid communication port.

16. The method of claim 12, wherein the third configuration is substantially the same as the first configuration.

17. The method of claim 12, wherein a second degradable seal is exposed to a condition in the third configuration that degrades the second degradable seal, and degradation of the second degradable seal opens a second passage to a second chamber such that fluid enters the second chamber and urges the sliding member in the first axial direction relative to the tubular to a fourth configuration.

18. The method of claim 17, wherein the fourth configuration is substantially the same as the second configuration.

19. The method of claim 12, wherein the sliding member includes a passage that opens into the chamber, the degradable seal being disposed in the passage.

20. The method of claim 12, wherein the degradable seal is a plug and wherein the condition is a hydraulic condition, an electrical condition, or a thermal condition.

21. The method of claim 12, wherein the degradable seal is sealed by a second seal when the sliding member is in the first configuration.

22. A multi-acting downhole tool comprising:

a tool housing;

a pressure responsive actuator disposed at least partially within the tool housing and in a first configuration, the tool housing and actuator cooperatively define a chamber therebetween; and at least a pair of seals delimiting the chamber, a first one of the pair of seals being a degradable seal, and wherein upon actuation, the actuator transitions to a second configuration and as a result of the transition of the actuator to the second configuration the degradable seal is exposed to a condition that degrades the degradable seal, and degradation of the degradable seal opens a passage to the chamber such that fluid enters the chamber and transitions the actuator to a third configuration in which the actuator is poised for actuation to the second configuration upon pressure actuation.

23. The arrangement of claim 22, wherein the degradable seal is sealed by a second seal prior to the actuator transitioning to the second configuration.

* * * * *